US005605039A

United States Patent [19]

Meyer et al.

[11] Patent Number: 5,605,039

[45] Date of Patent: Feb. 25, 1997

[54] PARALLEL ARCJET STARTER SYSTEM

[75] Inventors: Steven D. Meyer, Snohomish; Robert J. Kay, Kirkland, both of Wash.

[73] Assignee: Olin Corporation, Redmond, Wash.

[21] Appl. No.: 543,659

[22] Filed: Oct. 16, 1995

Related U.S. Application Data

[63] Continuation-in-part of Ser. No. 92,299, Jul. 15, 1993, Pat. No. 5,513,087.

[51] Int. Cl.[6] ..... F03H 1/00

[52] U.S. Cl. ..... 60/204; 60/203.1

[58] Field of Search ..... 60/204, 203.1; 219/121.57; 313/231.41

[56] References Cited

U.S. PATENT DOCUMENTS

| | | | |
|---|---|---|---|
| 3,629,759 | 12/1971 | Douglas et al. . | |
| 4,122,816 | 10/1978 | Fitzgerald et al. . | |
| 4,138,783 | 2/1979 | Portier . | |
| 4,766,286 | 8/1988 | Iceland . | |
| 4,766,724 | 8/1988 | Gruber . | |
| 4,800,716 | 1/1989 | Smith et al. | 60/203.1 |
| 4,805,400 | 2/1989 | Knowles | 60/203.1 |
| 4,918,285 | 4/1990 | Thommes . | |
| 4,926,632 | 5/1990 | Smith et al. . | |
| 4,995,231 | 2/1991 | Smith et al. . | |
| 5,036,176 | 7/1991 | Yamaguchi et al. . | |
| 5,296,665 | 3/1994 | Peterson et al. . | |
| 5,352,861 | 10/1994 | Steigerwald et al. | 60/203.1 |
| 5,359,180 | 10/1994 | Park et al. . | |
| 5,414,238 | 5/1995 | Steigerwald et al. | 219/121.57 |

OTHER PUBLICATIONS

Northam et al. "Development and Evaluation of a Plasma Jet Flameholder for Scramjets" AIAA/SAE/ASME 20th Joint Propulsion Conference (Jun. 11–13, 1984/Cincinnati, Ohio) American Inst. Of Aeronautics & Astronautics, 1633 Broadway, New York, NY 10019, pp. 1 and 9.

Sato et al. "Effectiveness of Plasma Torches for Ignition and Flameholding in Scramjets" AIAA/ASME/SAE 25th Joint Propulsion Conference. Monterey, CA/Jul. 10–12, 1989, American Inst. Of Aeronautics & Astronautics, 370 L'Enfant Promenade, S.W. D.C. 20024, pp. 1–7.

Lewis Research Center, Cleveland, Ohio. "Arcjet Power Supply and Starting Circuit—Power Efficiency is High, Current is Regulated and Starting is Automatic". NASA Tech. Briefs. Jan. 1988. pp. 22–23.

Anne–Marie Warris and Felix Weinberg (Imperial College, London) "Ignition and Flame Stabilization by Plasma Jets in Fast Gas Streams" Twentieth Symposium (International) on Combustion/The Combustion Institute 1984. pp. 1825–1831. Tester, appearing at pp. 409–411.

*Primary Examiner*—Louis J. Casaregola
*Attorney, Agent, or Firm*—Robert S. Hauser

[57] ABSTRACT

There is disclosed an arcjet starter for igniting and sustaining an electric arc in an arcjet thruster. The arcjet starter is capable of delivering a short duration, high voltage pulse for igniting the arc and then providing a continuous low voltage, high amperage current for sustaining the arc. The starter has two separate magnetics, one for initiating breakdown in the arcjet and another for sustaining breakdown during steady state operation.

14 Claims, 4 Drawing Sheets

PARALLEL ARCJET STARTER SYSTEM

CROSS REFERENCE TO RELATED APPLICATION

This application is a continuation-in-part of U.S. patent application Ser. No. 08/092,299, filed on Jul. 15, 1993 (U.S. Pat. No. 5,513,087), the content for which is relied upon and incorporated by reference.

BACKGROUND OF THE INVENTION

1. Field of the Invention

The present invention relates to arc discharge devices and particularly to a system for producing a high voltage initiation pulse to start the discharge in such devices.

2. Description of the Related Art

Arcjets operate by heating a gas with an electric arc and expanding the heated gas through a nozzle to provide thrust. A high voltage, on the order of 5,000–6,000 volts, is required to ignite the arcjet thruster and form an electric arc between a cathode and an anode. Once the electric arc is established, the voltage necessary to sustain that arc is much less, on the order of 100 volts. An arcjet thruster thus requires two types of power, a high voltage pulse to ignite the electric arc and a relatively lower constant voltage to maintain the arc.

Several electric starters for arcjets are conventionally used. In one, as disclosed in U.S. Pat. No. 4,766,724 to Gruber, a flyback inductor is in series with the power supply and arcjet thruster. This type of starter must be capable of supporting full load power after startup has occurred. The inductor must be capable of maintaining a fixed minimum inductance during start up and a fixed minimum current during operation. Satisfying both of these requirements with a single inductor will require a large, heavy device. This weight penalty is not desirable in aerospace and outer space applications.

In a second starter, a shunt incorporates a high voltage diode blocking device in series with the power control unit output. The diode must be capable of sustaining full output current from the power control unit after startup. Again, the suitable diode would be heavy and have high internal resistance degrading power control unit efficiency.

In a third alternative, the ignition voltage is provided from a stand alone starter circuit which is removed once the electric arc is established. While such a system is effective for ground based operations such as arc welders, the weight of the separate starter makes this approach impractical for aerospace or outer space applications.

In the flyback starter approach, an output filter inductor functions as both a filter inductor and as a starter. In the starter role, a pulse width modulated converter charges the inductor up to a required energy for breakdown with maximum output capacitance and maximum possible breakdown voltage. The required energy level determines a minimum amount of energy to be stored and therefore establishes a minimum size of the inductor.

In the filter inductor role at low switching frequencies, the inductor must be large so that start constraints do not drive the design. Increasing the switching frequency permits significantly reducing the size of the output filter inductor and thus reduces inductor weight. However, starting energy level requirements in a flyback starter prevent reduction below that necessary for startup. The starting energy level requirement is related to cable capacitance and does not decrease significantly when switching frequency is increased.

Hence, while increasing the power converter operation frequency allows the output filter inductor to be reduced in size, this reduction is limited in the conventional flyback approach.

The combined presence of both high voltage and high power stresses in the same piece of magnetics further affects the size of the flyback start inductor. A space environment, for example, makes accommodation of these two stresses difficult.

Accordingly, an improved starter is needed that minimizes the size and weight of the output filter inductor and other magnetics in arcjet discharge systems while not being subject to the limitations of current approaches.

Additionally, an arcjet discharge system is needed that will reduce starting damage to the discharge unit.

Accordingly, this invention is directed to an arc discharge system that substantially obviates one or more of the problems due to limitations and disadvantages of the prior art.

There exists a need for an electric circuit to ignite an arcjet thruster and maintain the electric arc subsequent to ignition which does not have the problems of the prior art.

SUMMARY OF THE INVENTION

Accordingly, it is an object of the invention to provide an electric circuit capable of providing a voltage effective to ignite an arcjet thruster and then to maintain that electric arc. It is a feature of the invention that the circuit contains a plurality of power control units in series with low impedance inductors. A plurality of high impedance inductors are disposed between the power control units and low impedance inductors. The high impedance inductors magnetically saturate when current begins to flow. The steady state current then flows through the low impedance inductors.

It is an advantage of the invention that a high amperage, high voltage diode is not required as a blocking device. Still another advantage is that power lost in the starter circuit is minimal.

In accordance with the invention, there is provided a direct current power supply. The power supply includes a controlled constant current power source. One or more parallel low impedance inductors have a common input and a common output. The common input is in series with the controlled constant current power source. The common output is in series with the device to be powered. One or more constant current power control units are in series with the low impedance inductors. One or more high impedance inductors which are capable of magnetic saturation are in series with the constant current power control unit. Connected in parallel with the common output of the circuit is a high voltage, high energy start pulse generating circuit. This circuit is decoupled from the inductor circuit first by the high impedance inductors during start up and then by a diode during steady state operation.

Also, the system of the present invention, the starting and filtering functions are handled by separate magnetics. This allows the output filter inductor to be optimized for ripple filtering without concern for starting ability and a much smaller magnetic may be used to generate the high voltage pulse, which magnetic is operated in a forward mode instead of the flyback mode of the prior art.

Alternatively, an arcjet starter, having an arcjet with a breakdown voltage, an initial voltage, and an operating voltage, may include a current supply, a shunt circuit connected the current supply and ground for establishing an initial current in the current supply, a starter circuit connected between the arcjet and ground for initiating breakdown in the arcjet, and a diverter switch connected between the current supply and the arcjet for connecting the current supply to the arcjet when the arcjet is in breakdown, a control circuit for controlling the shunt circuit, the starter circuit, and the diverter switch.

According to another embodiment, a method for starting and operating an arcjet includes the steps of establishing an initial current in a current supply path, establishing a voltage on the arcjet sufficient to initiate breakdown, and connecting the arcjet to the supply path after breakdown.

It is to be understood that both the foregoing general descriptions and the following detailed descriptions are exemplary and explanatory and are intended to provide further explanation of the invention as claimed.

The accompanying drawing is included to provide a further understanding of the invention and are incorporated in and constitute a part of the specification illustrating an embodiment of the invention and together with the description serves to explain the principles of the invention.

IN THE DRAWINGS

FIG. 1 shows in cross sectional representation an arcjet thruster as known from the prior art; FIG. 2 schematically shows a circuit for igniting an arcjet thruster as known from the prior art;

FIG. 3 schematically shows a circuit for igniting an arcjet thruster as known from the prior art;

FIG. 4 schematically shows a circuit for igniting an arcjet thruster in accordance with the present invention;

FIG. 5 graphically illustrates the current characteristics of the ignition system of the present invention;

DETAILED DESCRIPTION

Figure 1:
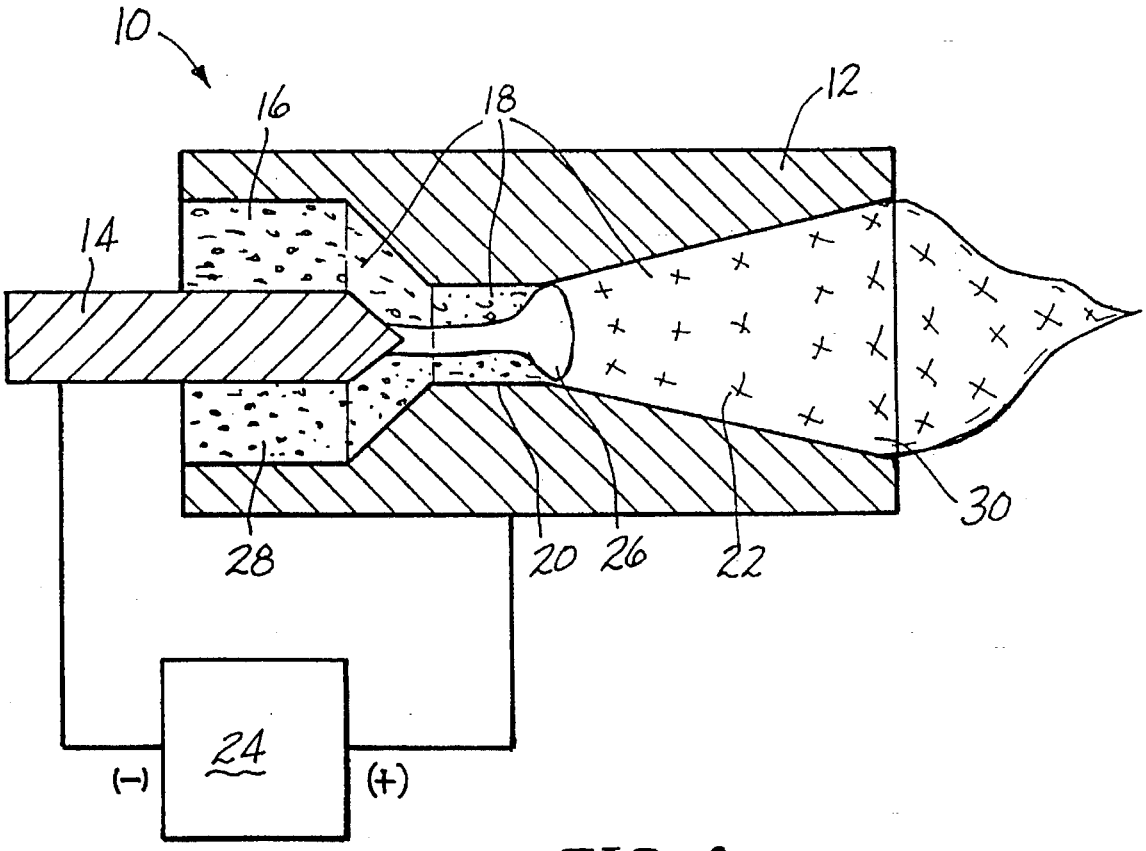
PRIOR ART FIG-1

FIG. 1 shows in cross sectional representation an arcjet thruster 10 as known from the prior art and described in U.S. Pat. No. 4,926,632 to Smith et al. which is incorporated by reference in its entirety herein. The arcjet thruster 10 includes an anode 12 and a cathode 14 centrally disposed in an aperture 16 formed in the anode 12. The anode 12 and cathode 14 are any suitable electrically conductive metal such as tungsten. The anode 12 includes an arc chamber 18 defined by a constricted throat 20 and a nozzle 22. A direct current power supply 24 generates a voltage differential between the anode 12 and cathode 14. When a sufficiently large voltage differential is present, an electric arc 26 is generated. The electric arc 26 attaches to the walls of the nozzle 22 slightly downstream of the constricted throat 20.

A plasma source gas 28, such as hydrogen, is introduced to the aperture 16 and flows through the electric arc 26 where it is heated to temperatures in excess of about 3000° C. The super heated plasma 30 is exhausted through the nozzle 22 at supersonic speeds generating the thrust to drive arcjet thruster 10.

The voltage required to initiate the electric arc 26 is on the order of several thousand volts. Once the electric arc is established, maintaining that electric arc requires a voltage on the order of 100 volts. The power supply 24, must be capable of providing a high voltage pulse to initiate the electric arc 26 and low voltage, high current power to maintain the arc.

Figure 2:
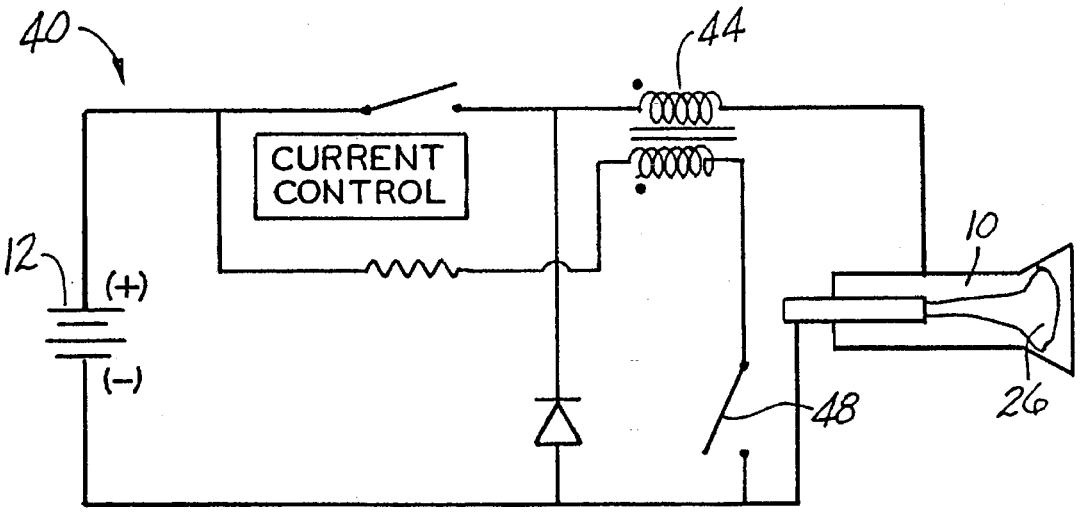
PRIOR ART FIG-2

FIG. 2 schematically illustrates a circuit 40 for igniting an electric arc 26 in an arcjet thruster 10. The circuit 40 includes a direct current power supply 42. The output from the power supply 42 flows to an inductor 44 in series with both the power supply 42 and arcjet thruster 10. A switch 48 determines whether the circuit 40 is in a power build up mode, when the switch is closed, or in an ignition mode when the switch 48 is open. For an arcjet thruster 10 rated at 26 kilowatts, a 5 kilovolts pulse having a duration of about 0.5 microseconds is required for ignition.

Figure 3:
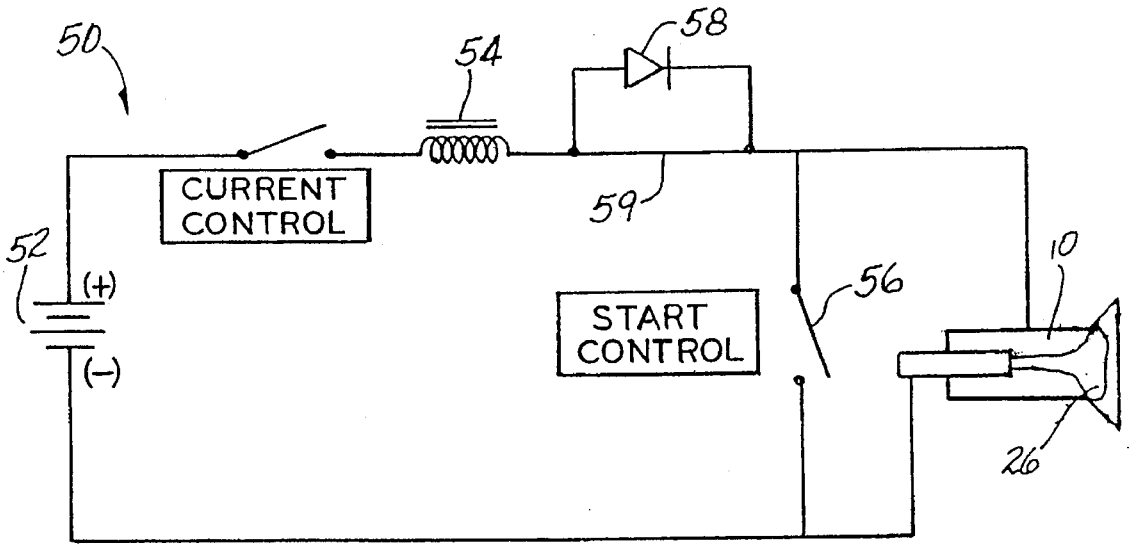
PRIOR ART FIG-3

FIG. 3 schematically illustrates another circuit 50 for igniting an electric arc 26 in an arcjet thruster 10 as known from the prior art. The circuit 50 includes a direct current power supply 52. The output from the direct current power supply 52 flows to an inductor 54 in series with both the power supply 52 and the arcjet thruster 10. A switch 56 determines whether the circuit 50 is in a power build up mode, when the switch is closed, or in an ignition mode, when the switch is open.

As disclosed above, a 5 kilovolt, 0.5 microsecond pulse will ignite the arcjet thruster. This pulse could be generated by closing switch 56 and allowing the current to rise in inductor 54, storing energy in the inductor. When switch 56 is opened, the magnetic field associated with inductor 54 collapses and a high voltage pulse crosses the switch 56 and arcjet thruster 10.

The resultant current absorbed by the inductor 54, when rated, for example, at 16.7 microhenry, and not available to the arcjet thruster 10 from the 5 kilovolt pulse is about:

$$i=(V/L)\ \Delta t=(5\times10^3/16.7\times10^{-6})\times0.5\times10^{-6}$$

$$i=149.7 \text{ amps.}$$

Typically, the circuit 50 cannot provide this amount of current at the 5 kilovolt level. A blocking diode 58 would allow sufficient voltage build up. If diode 58 is present, short 59 is removed. However, once the arcjet thruster 10 is ignited, the circuit 50 will eventually output a constant current of about 236 amps. At this current, assuming a forward drop of only 5 volts for the 5 kilovolt diode 58, the power loss in the diode is 1180 watts. Power loss of this magnitude generates excessive heat and is an excessive drain on the power supply. 52.

Figure 4:
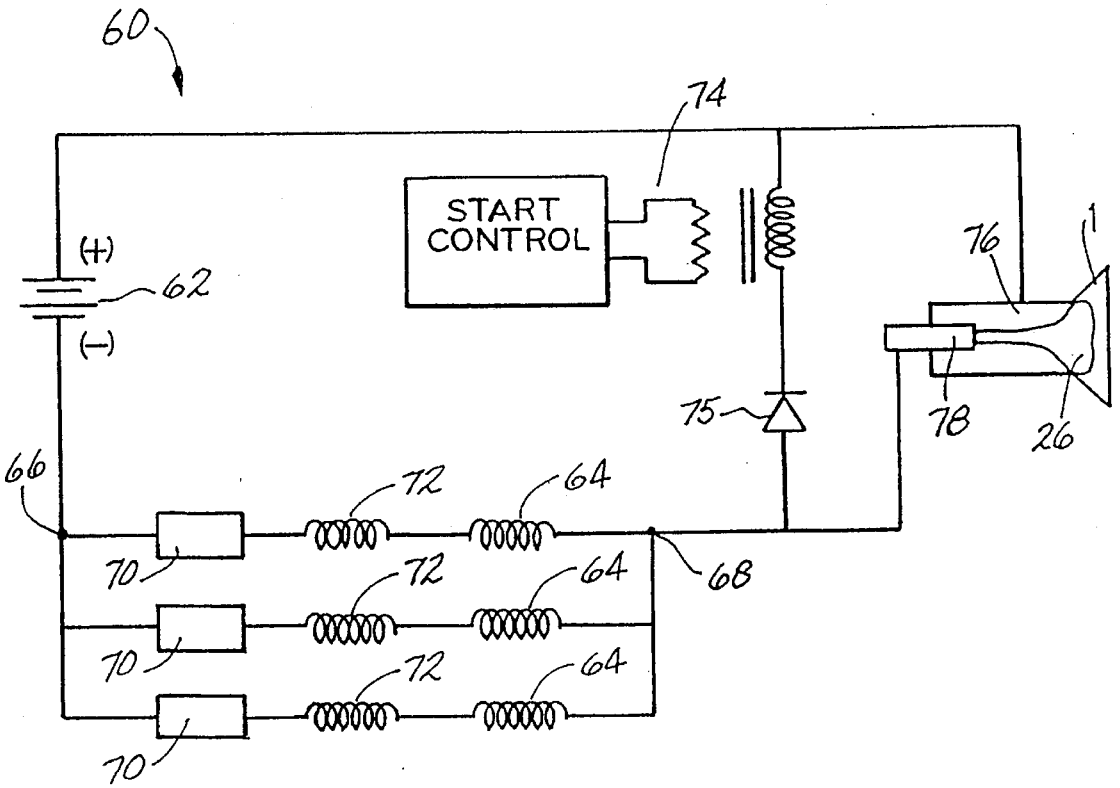

FIG. 4 schematically illustrates a circuit 60 for igniting an arcjet thruster 10 and maintaining an electric arc 26 after ignition in accordance with the invention. The circuit 60 includes a direct current power supply 62 capable of providing a sufficient voltage and amperage. Generally, a 220 volt direct current power supply is suitable. One or more of parallel low impedance inductors 64 have a common input 66 and common output 68. The common input is in series with direct current voltage source 62 while the common output 68 is in series with the arcjet thruster 10.

The low impedance inductors are formed from a low magnetic permeability material such a molypermalloy and each has an impedance of less than about 200 microhenry. More preferably, the impedance is from about 5 to about 100 microhenry and most preferably from about 10 to about 50 microhenry. The desired inductance is inversely proportional to the frequency of the circuit:

$$1\propto v/(\Delta I\cdot F)$$

One or more constant current power control units 70 are arranged in series with the low impedance inductors 64.

While not required to ignite the arcjet thruster 10, the constant power control unit 70 provide a constant low voltage, on the order of 100 volts, high amperage, on the order of 80 amps, to maintain the electric arc 26. In series with the low impedance inductor 64 and the constant current power control unit 70 is one or more high impedance inductors 72. The high impedance inductors 72 are capable of magnetic saturation and have a core of a suitable magnetic saturable material such as ferrite or amorphous iron. The impedance of the high impedance inductors 72 is from about $10^1$ to about $10^5$ times the impedance of the low impedance inductors 64. More preferably, the impedance of the high impedance inductors 72 is from about $10^{1.5}$ to about $10^{2.5}$ times the impedance of the low impedance inductors 64. Preferably, the impedance of the high impedance inductor 72 is from about 5 millihenry to about 20 millihenry and more preferably from about 8 millihenry to about 12 millihenry.

Typically, three high impedance inductors 72 are arranged in parallel. The net inductance of the high impedance inductors 72 is therefore 5/3 millihenry to about 20/3 millihenry. An exemplary net inductance is about 3 millihenry.

Figure 5:
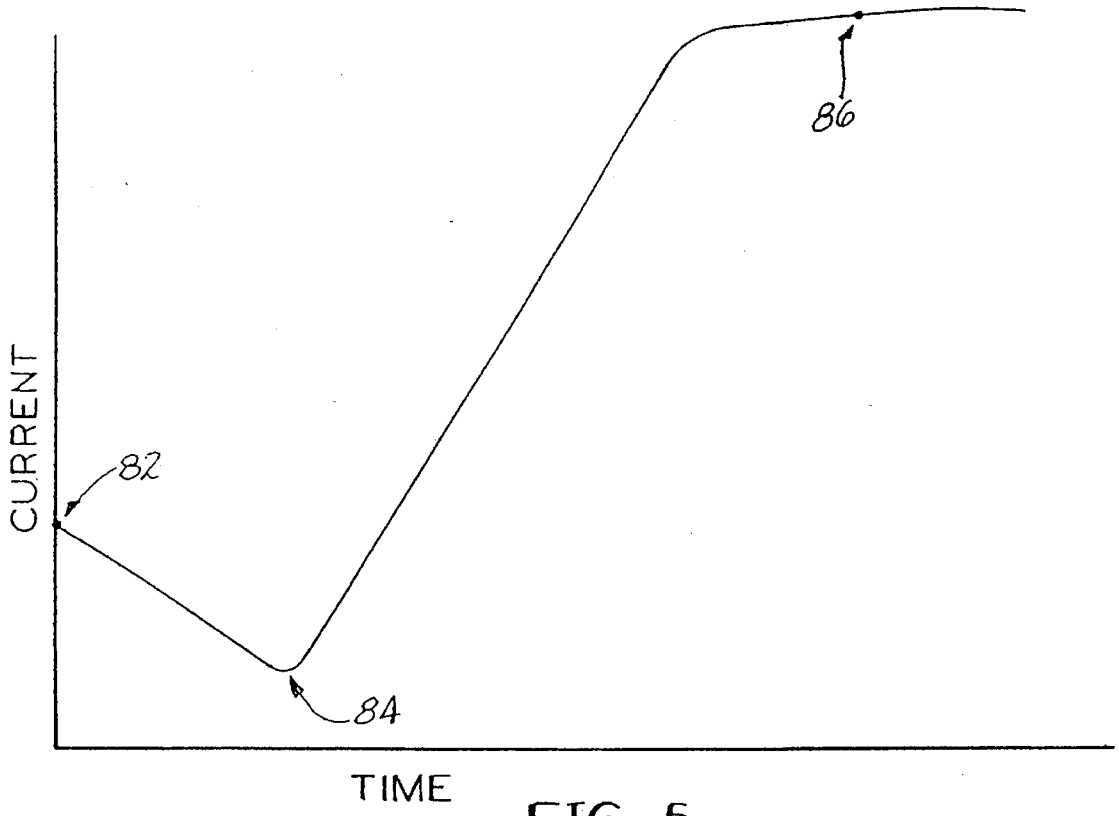

A start circuit 74, typically consisting of a high voltage pulse generator and a decoupling high voltage diode 75 generates the requisite start pulse. Operation of the circuit 60 is best understood with reference to FIGS. 4 and 5. FIG. 5 graphically illustrates the current passing through the arcjet 10. The arcjet is initiated by the starter 74 generating a high voltage pulse via diode 75. Inductors 72 provide a sufficient block and isolate the low current control part of the total circuit. Upon arcjet 10 voltage breakdown current begins to flow from the starter 74 through the plasma 26 (82 in FIG. 5). The current through the arcjet thruster 10 decreases as the electric arc 26 achieves steady state operation. At this point, the voltage across the arcjet is about 120 volts and the voltage difference across the high impedance blockers 72 is about 100 volts. Current begins to flow from the power control units 70 and rapid magnetic saturation of the high impedance inductors 72 occurs. The minimum current of about 6 amps (84 in FIG. 4) is reached at full magnetic saturation. The time to full magnetic saturation is from about 50 to about 200 microseconds, and preferably from about 100 to about 150 microseconds.

When the high impedance inductors 72 reach full magnetic saturation they effectively become invisible from the circuit. The low impedance inductor 64 takes effect and the steady state conditions of a voltage from about 75 to about 150 volts and a current from about 70 to about 100 amps (86 in FIG. 4) go into effect. This low voltage steady state is sufficient to maintain electric arc 26 without damage to the anode 76 and cathode 78.

Use of the circuit 60 prevents the constant current power control units 70 from absorbing energy from the starter. The high impedance inductors 72 are nominally at 9 millihenry. These high impedance inductors 72 are connected in series with the low impedance, nominally 50 microhenry, inductors. The net inductance is thus approximately 3 millihenry and the resulting current absorbed during the ignition sequence is:

$$i=(V/L\ \Delta t=(5\times10^3)/3\times10^{-3})\times0.5\times10^{-6}$$

$$i=0.833 \text{ amps.}$$

This is an acceptable current level and provides minimal additional load for the starter circuit. Based on a design that would incorporate the high impedance inductors 72 as part of the output, the effective direct current losses would be power lost in the added resistance of the inductors. Conservatively, this addition is about 0.00075 ohms per inductor. For a three inductor system, the increase is 0.00075/3=250 microhms. The net power loss is:

$$P=(236.7)^2\times250\times10^{-6}$$

P is approximately 14 watts total which is an acceptably small loss. Since the start circuit ceases operation after start up and the diode 75 is reverse biased, no steady state power is lost in the starter or in the diode.

Figure 6:
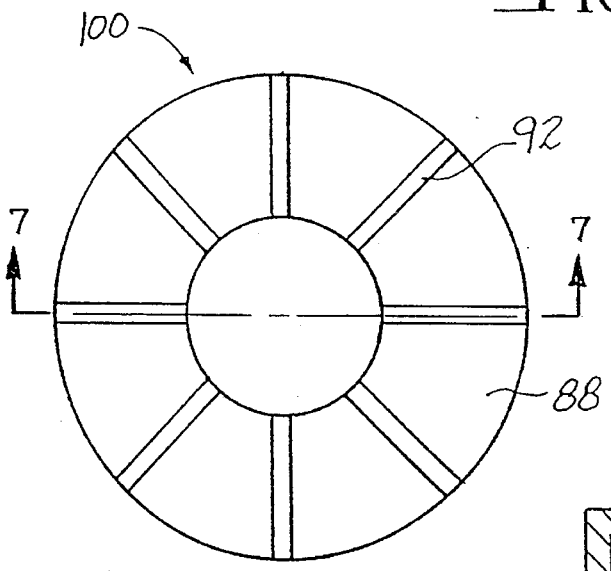
FIG. 6 shows in top planar view an inductor for use in the present invention.
Figure 7:
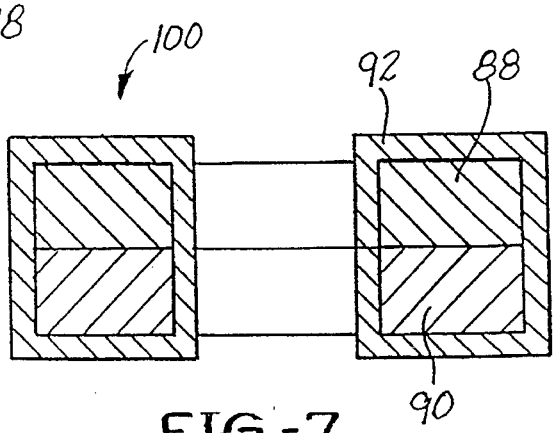
FIG. 7 shows a cross sectional representation the inductor of FIG. 6.

The structure of the inductors is illustrated in top planar view in FIG. 6 and cross-sectional representation in FIG. 7. The inductor 100 is a stacked toroidal core which may have multiple first layers 88 and second layers 90 to achieve the desired impedance. The first layers 88 correspond to the high impedance inductors and have a first magnetic permeability. The second layers 90 correspond to the low impedance inductors and have a second magnetic permeability. This second magnetic permeability is from about $\mathbf{10^{-2}}$ to about $\mathbf{10^{-5}}$ that of the first magnetic permeability. Preferably, the magnetic permeability ratio is from about $\mathbf{10^{-2.5}}$ to about $\mathbf{10^{-3.5}}$.

As an example, the first layer 88 can be ferrite with a relative magnetic permeability of 19,000 and the second layer 90 molypermalloy with a relative magnetic permeability of 26.

A copper wire 92 is wrapped around the stacked cores 88, 90 an effective number of turns. The preferred inductor 100 meets the following criteria:

1. The permeability of the first layer 88 must be substantially higher than the magnetic permeability of the second layer 90. In this way, the inductance during ignition of an arcjet thruster is much larger than the inductance during maintenance of the arc.
2. The first layer 88 must be capable of sustaining the volt-second product of the high voltage start pulse without going into saturation, ie. saturation should require at least 0.5 microsecond and preferably up to about 1–1.5 microseconds at the 5 kilovolt start pulse level. This provides the approximate open switch (blocking) mode. If the first layer 88 saturates during the start pulsing, the start pulse is degraded and arcjet startup will not occur.
3. The first layer 88 must be capable of saturating very quickly, on the order of from about 50 to about 200 microseconds, and more preferably on the order of from about 100 to about 150 microseconds, at the 100 volt level after the arcjet has started. This allows normal operation current to flow. In the steady operation mode, the inductor 100 impedance is low and the effect on the power control unit efficiency and dynamic performance is negligible.

An exemplary material for the first layer 88 is ferrite and for the second layer 90 molypermalloy. The wire 92 is any conductive material such as copper of sufficient gauge to sustain the high current passing through the inductor 100 amps. During steady state operation, this current is on the order of from about 50 to about 100. One exemplary copper wire is interwoven strands of 14 gauge wire. Typically, from about 7 to about 10 strands of 14 gauge wire wrapped around the toroidal core from about 15 to about 25 times is suitable. In one working model, the copper wire 92 comprised 20 turns of 9 interwoven strands of 14 gauge copper wire.

While described in terms of an ignition circuit for an arcjet thruster, the electric circuit of the invention is suitable for any device in which a short duration high voltage pulse followed by sustained low voltage, high current power is required.

Figure 8:
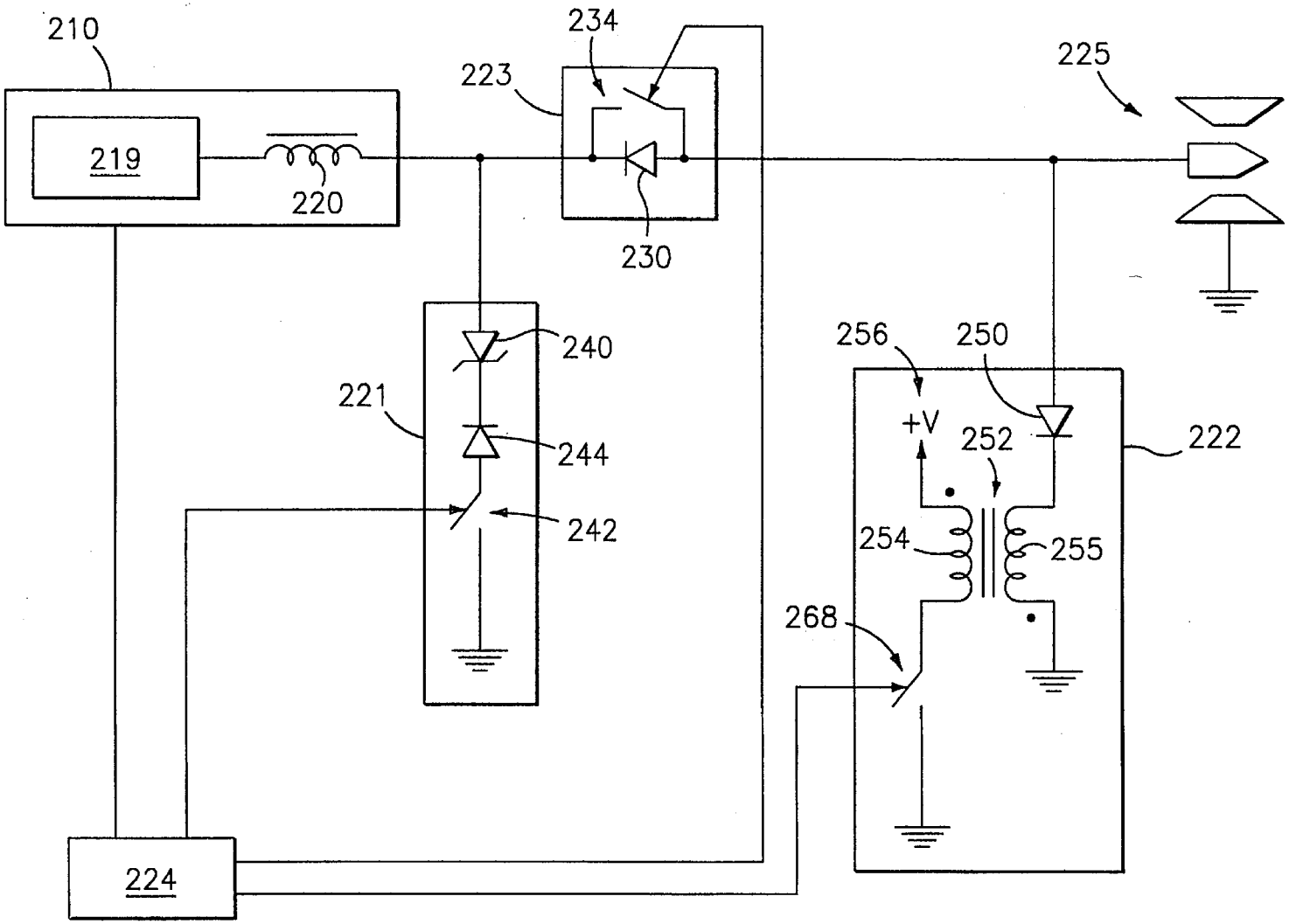
FIG. 8 is a diagram of an alternative arc discharge system and start circuit.

Reference will now be made in detail to alternative preferred embodiment of the invention, an example of which is illustrated in FIG. 8.

While the embodiment will be described in terms of a preferred embodiment involving an arcjet thruster system, it will be understood that the invention is applicable to other implementations where a high voltage initialization pulse is used, such as, in welding devices, plasma torches, gas discharge lamps, arc heating systems, and related applications.

An exemplary embodiment of a system for providing power in an arcjet, the present invention includes a current supply, a shunt circuit, a start circuit, a diverter switch and a control circuit.

As embodied herein and referring to FIG. 8, an arcjet starter includes current supply 210, shunt circuit 221, start circuit 222, diverter switch 223, control circuit 224, and arcjet 225. Current supply 210 is connected to arcjet 225 through diverter switch 223. Shunt circuit 221 is connected between a common connection between current supply 210 and diverter switch 223 and ground. Start circuit 222 is connected between ground and the common connection point of diverter switch 223 and arcjet 225. Control circuit 224 connects to shunt circuit 221, start circuit 222, diverter switch 223, and current supply 210.

Preferably current supply 210 includes inductor filter 220 with one end connected to a power converter 219 and the other end connected to both shunt circuit 221 and diverter switch 223.

Shunt circuit 221, preferably includes a zener diode, a diode and a switch. As embodied herein, shunt circuit 221 includes zener diode 240, shunt switch 242 and shunt diode 244 connected in series. As illustrated in FIG. 8, the anode of zener diode 240 connects to the common point between inductor filter 220 and diverter switch 223 and the cathode connects to the cathode of shunt diode 244. Switch 242 connects the anode of shunt diode 242 to ground. Thus, shunt circuit 221 allows current to flow from ground to current supply 210 when shunt switch 242 is closed. Moreover, the series connection of zener diode 240, shunt diode 244, and shunt switch 242 may be in any order.

As embodied herein, starter circuit 222 includes a starter diode, a transformer and a starter switch connected in series from arcjet 225 to ground. The order of connection is not important. Starter circuit 222 includes starter diode 250, transformer 252 having primary winding 254 and secondary winding 255, voltage source 256, and starter switch 268.

Starter diode 250 connects between the common point connection of diverter switch 223 and arcjet 225 and to transformer 252. More preferably, the anode of starter diode 250 connects to both arcjet 225 and diverter switch 223 and the cathode of starter diode 250 connects to secondary winding 255. Thus, starter diode 250 allows current to freely flow from ground through arcjet 225 to secondary winding 255 and back to ground. In a steady state operation, starter diode 250 is reverse biased, however, during starting, starter diode 250 is forward biased.

Transformer 252 includes primary winding 254 and secondary winding 255. Primary winding 254 connects voltage source 256 to start switch 268. Secondary winding 255 is magnetically coupled with reverse polarity to primary winding 254 and also connects the cathode of shunt diode 250 to ground. Transformer 252 couples primary winding 254 to secondary winding 255 so that a positive voltage appearing at the point where primary winding 254 connects to voltage source 256 appears as a negative voltage at the point where secondary winding 255 connects to the cathode of start diode 250. Start switch 268 connects primary winding 254 to ground.

Diverter switch 223 connects current supply 210 and shunt circuit 221 to arcjet 225 and start circuit 222. Preferably, diverter switch 223 includes diverter diode 230 and diverter shunt switch 234 connected in parallel. The anode of diverter diode 230 connects to arcjet 225 and starter circuit 223. The cathode of diverter diode 225 connects to current supply 210 and shunt circuit 221.

In operation, diverter switch 223 serves to isolate shunt circuit 221 and current supply 210 from arcjet 225 and start circuit 222 while shunt circuit 221 establishes an initial current through filter inductor 220. After shunt circuit 221 has established an initial current in inductor filter 220, control circuit 224 operates switch 268 causing start circuit 222 to initiate breakdown in arcjet 225. Breakdown occurs when a sufficient voltage is present on arcjet 225 to cause an arc to be created from arcjet 225 to ground. Once arcjet 225 is in breakdown, control circuit 224 closes diverter switch 223 diverting current from shunt circuit 221 to arcjet 225.

Thus, starting and filtering functions are handled by separate magnetics. The starting functions are handled by start circuit 222 and the filter functions are handled by filter inductor 220. This allows filter inductor 220 to be optimized for ripple filtering without concern for starting ability. Accordingly, a much smaller magnetic may be used in start circuit 222 to generate a high voltage breakdown pulse, and operated in a forward mode instead of the flyback mode of the prior art. More specifically, prior to arcjet operation, switches 242, 234 and 268 are in an open position so that current does not flow through them. To begin starting the arcjet, control circuit 224 closes shunt switch 242 causing current to flow from ground through shunt switch 242, shunt diode 244, zener diode 240 through filter inductor 220. Because diverter switch 234 is open and diverter diode 230 is reverse biased, no current flows in the direction toward arcjet 225. Furthermore, because zener diode 240 is reversely biased in this configuration, a voltage drop exists from the cathode to the anode of zener diode 240. This voltage, commonly referred to as a clamp voltage, represents the voltage drop across a diode-type arrangement when the diode-type device is reverse biased. Thus, the voltage appearing at the anode of zener diode 240 will be its clamp voltage below ground. Typically, this clamp voltage will be within the inclusive range of 30 to 120 volts. Preferably, zener diode 240 has a clamp voltage of 66 volts, so that a voltage of −66 volts appears at the anode of zener diode 240 when current flows through shunt circuit 221. Preferably, the clamp voltage magnitude is lower than the magnitude of the initial voltage appearing at arcjet 225 shortly after start circuit 222 has initiated breakdown.

After current has been established in inductor filter 220 for an appropriate amount of time, control circuit 224 initiates breakdown via circuit 222. The appropriate amount of time is determined as the amount of time necessary to charge filter inductor 220 to an amount necessary to sustain breakdown once arcjet 225 has been started. Preferably, this time period is approximately within the range of 1 to 5 milliseconds. More preferably, this time period is 1.5 milliseconds. A time period longer than 5 milliseconds increases stress on zener diode 240 and a time period too short may not sufficiently charge filter inductor 220.

After the time period has passed, control circuit 224 closes switch 268. Switch 268 allows current to flow from voltage source 256 to ground through primary winding 254. Current flowing through primary winding 254 causes a large negative voltage to appear on the secondary winding 255 at the cathode of starter diode 250. This large negative voltage also appears at arcjet 225 initiating breakdown. Accordingly, current will flow from arcjet 225 through starter diode 250 and secondary winding 255 to ground. Voltage source 256, primary winding 254, secondary winding 255, and starter diode 250 are chosen in such a way so that when switch 268 is closed by control circuit 224, the voltage created at arcjet 225 is of sufficient negative potential to initiate breakdown. Preferably, voltage source 256 and transformer 252 are chosen so that a voltage of approximately −5000 would appear at arcjet 225 if it did not break down.

When the voltage at arcjet 225 passes below the breakdown voltage, typically −1000 to −4000, an arc is created between a cathode of the arcjet and ground. After the arc is established, the voltage at arcjet 225 rises from the breakdown voltage to an initial voltage, typically −40 volts, and then settles to an operating voltage of typically −100. Although the actual voltage levels are functions of the materials and gasses used in the arcjet design, the principles apply to all uses of arcjets. For example, all arcjets will have a breakdown voltage, an initial voltage, and an operating voltage.

Once breakdown has occurred, control circuit 224 closes diverting switch 234 to divert current to flow from flow from arcjet 225 to filter inductor 220.

In operation, diverter diode 230 prevents current from flowing from shunt circuit 221 through starter circuit 222 to ground during arcjet startup and allows current to arcjet 225 to filter inductor 220 immediately after breakdown.

Initially, starter switch 268 causes the voltage at arcjet 225 to be −5000 as described earlier; but the voltage will rise to −40 volts before settling off at −100 volts during steady state operation. Because the voltage at the anode of zener diode 240 is −66 volts, current will more easily flow from the more positive arcjet 225 through diode 230 and through inductor filter 220 than from shunt circuit 221.

Once breakdown has been established, control circuit 224 closes diverter switch 234 to make the path of current from arcjet 225 to inductor filter 220 less resistant. Control circuit 224 then opens switch 242 before the voltage at arcjet 225 drops below the voltage at the anode of zener diode 240 and starter switch 268 to turn off shunt circuit 221 and starter circuit 222.

Although shunt circuit 221 is illustrated as a series combination of a zener diode, diode, and a switch, it may also be configured as a voltage source or any other type of circuit that can establish an initial current in inductor filter 220 until breakdown has been established in arcjet 225.

The zener clamp voltage of zener diode 240 is chosen to have a magnitude higher than the magnitude of the initial voltage of arcjet 225. Typically, this value is chosen to be in the inclusive range of 30 to 120 volts. Thus, after breakdown current will more easily flow from arcjet 225 to inductor filter 220 than through circuit 221 to inductor filter 220.

Although circuit 222 is illustrated as a series combination of a voltage source, a transformer, a diode, and a switch, it could be of any type of circuit that can establish an initial high magnitude voltage pulse sufficient to initiate breakdown in arcjet 225.

Diverter switch 223 as embodied and preferred in this invention consists of a switch and a diode in parallel. More preferably, diverter switch 223 is a high voltage vacuum relay. However, diverter switch 223 could also be a fast switch triggered immediately upon the initialization of breakdown in arcjet 225 to divert the current from shunt circuit 221 to inductor filter 222 to be current from arcjet 225 to filter inductor 220.

Although diode 230 and 250 are each illustrated as single diodes, in preferred operation, each of these diodes may consist of several thousand-volt diodes connected in series.

Additionally, a resistor may be connected in series with starter switch 268 and primary winding 254 to provide resistance and limit the current through primary winding 254.

Preferably, switches 242 and 268 are metal oxide semiconductor field effect transistor (MOSFET) devices.

The primary advantage of the above described invention lies is that the current path for starting arcjet 225 is separate from the current path for maintaining steady state operation of the arcjet. Thus, inductor filter 220 may be appropriately sized for steady state operation, allowing a designer to make inductor filter 220 smaller and save significant amounts of weight and cost while allowing the designer to optimize starter circuit 222 without regard to sufficient current ability to maintain the arcjet in breakdown.

While described in terms of an ignition circuit for an arcjet thruster, the electric circuit of the invention is suitable for any device in which a short duration high voltage pulse followed by sustained low voltage, high current power is required.

The patents set forth in the application are intended to be incorporated by reference in their entireties.

It is apparent that there has been provided in accordance with this invention a circuit which fully satisfies the objects, means and advantages set forth hereinabove. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. An arcjet starter, the arcjet having a breakdown voltage, an initial voltage, and an operating voltage, comprising:

a current supply;

a shunt circuit connected to the current supply and ground for establishing an initial current in the current supply;

a starter circuit connected between the arcjet and ground for initiating breakdown in the arcjet; and a diverter switch connected between the current supply and the arcjet for connecting the current supply to the arcjet when the arcjet is in breakdown;

a control circuit for controlling the shunt circuit, the starter circuit, and the diverter switch.

2. The apparatus according to claim 1, wherein the diverter switch comprises at least one diode, the at least one diode having an anode and a cathode, the anode connected to the arcjet and the cathode connected to the current supply.

3. The apparatus according to claim 2, wherein the diverter-switch further includes a single pole switch connected in parallel to the at least one diode for shunting the at least one diode when the arcjet is in breakdown.

4. The apparatus of according to claim 3, wherein the single pole switch is a vacuum relay.

5. The apparatus according to claim 1, wherein the shunt circuit comprises:

at least one zener diode, having an anode, a cathode, and a clamp voltage having a magnitude higher than the initial magnitude of the arcjet voltage, connected between the current supply and ground, the anode connected closer to the current supply than the cathode; and a shunt switch connected in series with the at least one zener diode for allowing current to flow from ground to establish the initial current in the current supply and for preventing current from flowing from ground through the shunt path after the arcjet voltage magnitude increases to a value higher than the clamp voltage magnitude.

6. The apparatus according to claim 5, wherein the shunt switch comprises:

a single pole switch connected in series with the zener diode for connecting the zener diode to ground to establish current in the current filter and disconnecting the diode from ground after the arcjet voltage magnitude rises above the zener clamp voltage magnitude; and a diode connected in series with the zener diode and the single pole switch, the anode connected closer to ground than the cathode.

7. The apparatus according to claim 6, wherein the single pole switch is a MOSFET.

8. The apparatus according to claim 2, wherein the shunt circuit comprises:

a voltage source; and a switch, the voltage source and the switch connected in series, the switch allowing current to flow from ground to establish the initial current in the current supply and for preventing current from flowing from ground through the shunt circuit after the arcjet voltage magnitude rises above the zener diode clamp voltage magnitude.

9. The apparatus according to claim 1, wherein the starter circuit comprises:

at least one diode, having an anode and a cathode, connected between the arcjet and ground, the anode connected closer to the arcjet than the cathode;

a transformer, having a primary winding and a secondary winding, connected in series with the diode, the primary winding coupled to a voltage source on a positive side and ground on a negative side, the secondary winding magnetically coupled with reverse polarity to the primary winding and connected in series with the diode to ground;

a switch connected in series with the primary winding to ground for connecting the primary winding to ground to initiate arcjet breakdown and disconnecting the primary winding after breakdown.

10. The apparatus of claim 3, wherein the reverse-bias clamp voltage of the zener diode is in the inclusive range 30 to 120 volts.

11. The apparatus of claim 9, wherein breakdown is initiated at approximately in the inclusive range of −1000 to −4000 volts.

12. The apparatus of claim 9, wherein the switch is a MOSFET.

13. A method for operating an arcjet comprising the steps of:

establishing an initial current in a current supply path;

establishing a voltage on the arcjet sufficient to initiate breakdown; and connecting the arcjet to the supply path after breakdown.

14. A method of operating an arcjet comprising the steps of:

providing a current supply;

establishing an initial current in the current supply by connecting a shunt circuit to ground;

creating, after establishing the initial current, a voltage on the arcjet sufficient to initiate breakdown by connecting a starter circuit to ground;

connecting the arcjet to the current supply after breakdown; and disconnecting the shunt circuit and the starter circuit from ground after breakdown.

* * * * *